US009815080B2

(12) United States Patent
Carmichael et al.

(10) Patent No.: US 9,815,080 B2
(45) Date of Patent: Nov. 14, 2017

(54) GLUING SYSTEM FOR APPLYING GLUE ON BOTTLE LABELS

(71) Applicant: SIDEL PARTICIPATIONS S.A.S., Octeville-sur-Mer (FR)

(72) Inventors: James Carmichael, Parma (IT); Marco Ferri, Parma (IT); Mattia Giuliani, Parma (IT)

(73) Assignee: SIDEL PARTICIPATIONS S.A.S., Octeville-Sur-Mer (FR)

( * ) Notice: Subject to any disclaimer, the term of this patent is extended or adjusted under 35 U.S.C. 154(b) by 0 days.

(21) Appl. No.: 14/940,205

(22) Filed: Nov. 13, 2015

(65) Prior Publication Data

US 2016/0136677 A1 May 19, 2016

(30) Foreign Application Priority Data

Nov. 19, 2014 (EP) ..... 14193958

(51) Int. Cl.
*B05C 1/08* (2006.01)
*B65C 9/20* (2006.01)
(Continued)

(52) U.S. Cl.
CPC ..... *B05C 1/0813* (2013.01); *B05C 11/1042* (2013.01); *B05C 11/1047* (2013.01);
(Continued)

(58) Field of Classification Search
CPC .. B05C 11/1039; B05C 1/0813; B05C 1/0817
(Continued)

(56) References Cited

U.S. PATENT DOCUMENTS 5,944,897 A * 8/1999 Braden ..... H01G 13/006 118/211
6,000,789 A * 12/1999 Takagi ..... B41J 2/17513 347/86

(Continued)

FOREIGN PATENT DOCUMENTS

DE 1182516 B 11/1964
DE 9313524 U1 10/1993

(Continued)

OTHER PUBLICATIONS

Extended European Search Report dated May 19, 2015 by the European Patent Office in counterpart European Patent Application No. 14193958.7.

*Primary Examiner* — Karl Kurple
(74) *Attorney, Agent, or Firm* — Finnegan, Henderson, Farabow, Garrett & Dunner, L.L.P.

(57) ABSTRACT

A gluing system for applying glue on products is disclosed. The gluing system includes a glue applicator configured to deposit melted glue on products, a glue container configured to contain excess melted glue discharged from the applicator and fresh melted glue, a glue delivering unit configured to deliver glue from the container to the applicator and a glue discharging unit configured to convey excess glue not used by the applicator to the container. The container is divided by a partition into a first chamber, containing the fresh melted glue, and into a second chamber containing the excess melted glue and separated from the first chamber. The partition includes a filter allowing flow of the fresh melted glue and the excess melted glue from both the first and second chambers to the delivering unit.

15 Claims, 5 Drawing Sheets

(51) Int. Cl.
*B65C 9/22* (2006.01)
*B05C 11/10* (2006.01)
*B65C 9/00* (2006.01)

(52) U.S. Cl.
CPC ..... *B65C 9/20* (2013.01); *B65C 9/2256* (2013.01); *B05C 1/0817* (2013.01); *B05C 1/0826* (2013.01); *B65C 2009/0071* (2013.01)

(58) Field of Classification Search
USPC ..... 347/85–89, 93; 118/688, 693
See application file for complete search history.

(56) References Cited

U.S. PATENT DOCUMENTS

| | | | | |
|---|---|---|---|---|
| 2002/0079051 | A1* | 6/2002 | McQuaid ..... | B05C 1/0813 156/278 |
| 2014/0311404 | A1 | 10/2014 | Eichhammer | |

FOREIGN PATENT DOCUMENTS

| | | | |
|---|---|---|---|
| EP | 0790081 | A2 | 8/1997 |
| EP | 2353730 | A1 | 8/2011 |

* cited by examiner

GLUING SYSTEM FOR APPLYING GLUE ON BOTTLE LABELS

CROSS-REFERENCE TO RELATED APPLICATIONS

This application claims the benefit of priority of European Patent Application No. 14193958.7, filed on Nov. 19, 2014, which is incorporated herein by reference.

TECHNICAL FIELD

The present invention relates to a gluing system for applying glue on products, in particular on labels destined to be then stuck on articles, such as vessels or bottles.

The following description will refer to this specific labelling field, although this is in no way intended to limit the scope of protection as defined by the accompanying claims.

BACKGROUND ART

As known, according to a widespread technique, labels are attached on the external surfaces of respective vessels or articles by means of glue previously applied on the back surfaces of the labels themselves.

In particular, labels are cut from a web at appropriate lengths and then advanced by a transfer drum towards an application station, at which labels are applied on the respective vessels or articles. Prior to reaching the application station, each label receives a layer of melted glue on its back surface by a gluing system including a rotatable glue roller cooperating tangentially with the transfer drum; in practice, as it is advanced by the transfer drum, each label contacts, on the opposite side thereof with respect to the transfer drum, the glue roller.

The gluing system further comprises:

- a tank set to a given hot temperature, such as 140-150° C., suitable to maintain the glue in a melted state; and
- a glue delivering line connecting an outlet section of the tank to the glue roller and adapted to continuously feed melted glue to the outer surface of the glue roller itself.

A glue scraper is arranged at the periphery of the glue roller and at a certain radial distance from the lateral surface thereof; the glue scraper removes the excess of glue and smoothes the surface of the glue layer applied onto the lateral surface of the glue roller.

The excess glue is recovered in the tank to be then recirculated to the glue roller together with the fresh glue present in the tank itself.

The described gluing system requires a bulky tank containing a large mass of glue maintained at high temperature for many days; in these conditions, the properties of glue degrade very quickly.

In addition, a large mass of glue is continuously recirculated between the tank and the glue roller; during such recirculation, glue is exposed to atmospheric agents, which accelerate degradation of glue properties after a few cycles.

Another factor that tends to deteriorate the adhesive properties of the glue is the continuous mixing of the fresh glue with the older recirculated glue with consequent contamination of the fresh glue. Plus, due to this continuous mixing, some fractions of the glue may be recirculated for long times prior to being applied on the labels, with consequent very low adhesion performances.

Furthermore, the known glue feeding systems require high costs for manufacture as well as for maintenance.

DISCLOSURE OF INVENTION

It is an object of the present invention to provide a gluing system designed to overcome, in a straightforward and low-cost manner, at least one of the aforementioned drawbacks.

According to the present invention, there is provided a gluing system as claimed in claim 1.

BRIEF DESCRIPTION OF THE DRAWINGS

A non-limiting embodiment of the present invention will be described by way of example with reference to the accompanying drawings, in which.

BEST MODE FOR CARRYING OUT THE INVENTION

Figure 1:
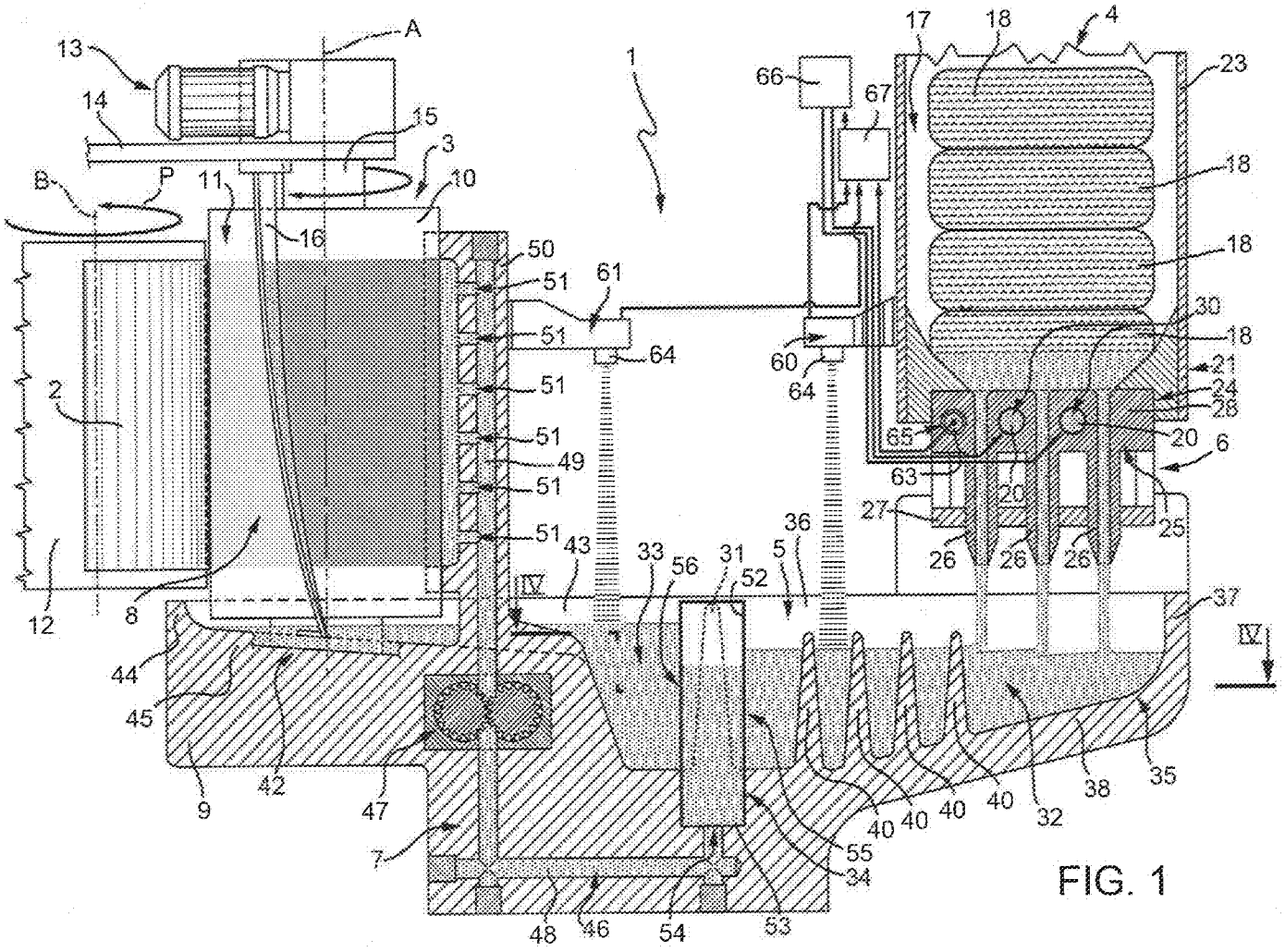
FIG. 1 shows a schematic, partially-sectioned side view of a gluing system according to the present invention for applying glue on labels destined to be stuck on articles.

Number 1 in FIG. 1 indicates as a whole a gluing system for applying glue on products, in particular on labels 2 destined to be then stuck on articles of all sorts, such as bottles or vessels (known per se and not shown).

Gluing system 1 comprises:

- a glue application apparatus 3 for depositing a layer of melted glue on labels 2;
- a glue storage container or first glue container 4 for storing fresh glue;
- a glue containing apparatus or second glue container, in particular a sump 5, containing in part excess melted glue discharged from application apparatus and in part fresh melted glue coming from storage container 4 and adapted to replenish the consumed glue;
- glue feeding means or glue feeder 6 to feed fresh melted glue from storage container 4 to sump 5;
- glue delivering means 7 to deliver melted glue from sump 5 to application apparatus 3; and
- glue discharging means 8 to convey excess glue not used by application apparatus 3 to sump 5.

As visible in FIG. 1, sump 5 is preferably formed in a base structure 9 of system 1 arranged below application apparatus 3 and storage container 4 so as to receive glue from them by gravity.

In the example shown, application apparatus 3 comprises a glue roller 10 mounted to rotate about a vertical axis A and having an outer cylindrical lateral surface 11, which is covered by melted glue continuously fed by delivering means 7. In particular, glue roller 10 is rotatably supported by base structure 9 and is placed thereon.

Labels 2 are retained in a known manner by suction on a transfer drum 12 (only partially shown), arranged tangentially adjacent to glue roller 10 and rotatable about an axis B, parallel to axis A, to advance the labels 2 along a circular path P of axis B towards an application station (known per se and not shown), at which the labels 2 themselves are applied on the respective articles.

In practice, as it is advanced by transfer drum 12, each label 2 contacts, on the opposite side thereof with respect to the transfer drum 12, the glue roller 10 to be spread with melted glue.

Application apparatus 3 further comprises an electric motor 13, which rests on a support plate 14 placed above glue roller 10 and has an output shaft 15 angularly connected to a core of the glue roller 10 itself to rotate the latter about axis A.

Discharging means 8 comprise a glue scraper 16, which, in the example shown, is defined by a curved blade projecting downwards from support plate 14 and arranged at the periphery of glue roller 10 and at a certain radial distance from lateral surface 11 of the glue roller 10 itself. Scraper 16 is adapted to remove the excess of glue from glue roller 10 during rotation thereof and to smooth the surface of the glue layer applied onto lateral surface 11 of the glue roller 10.

Figure 2:
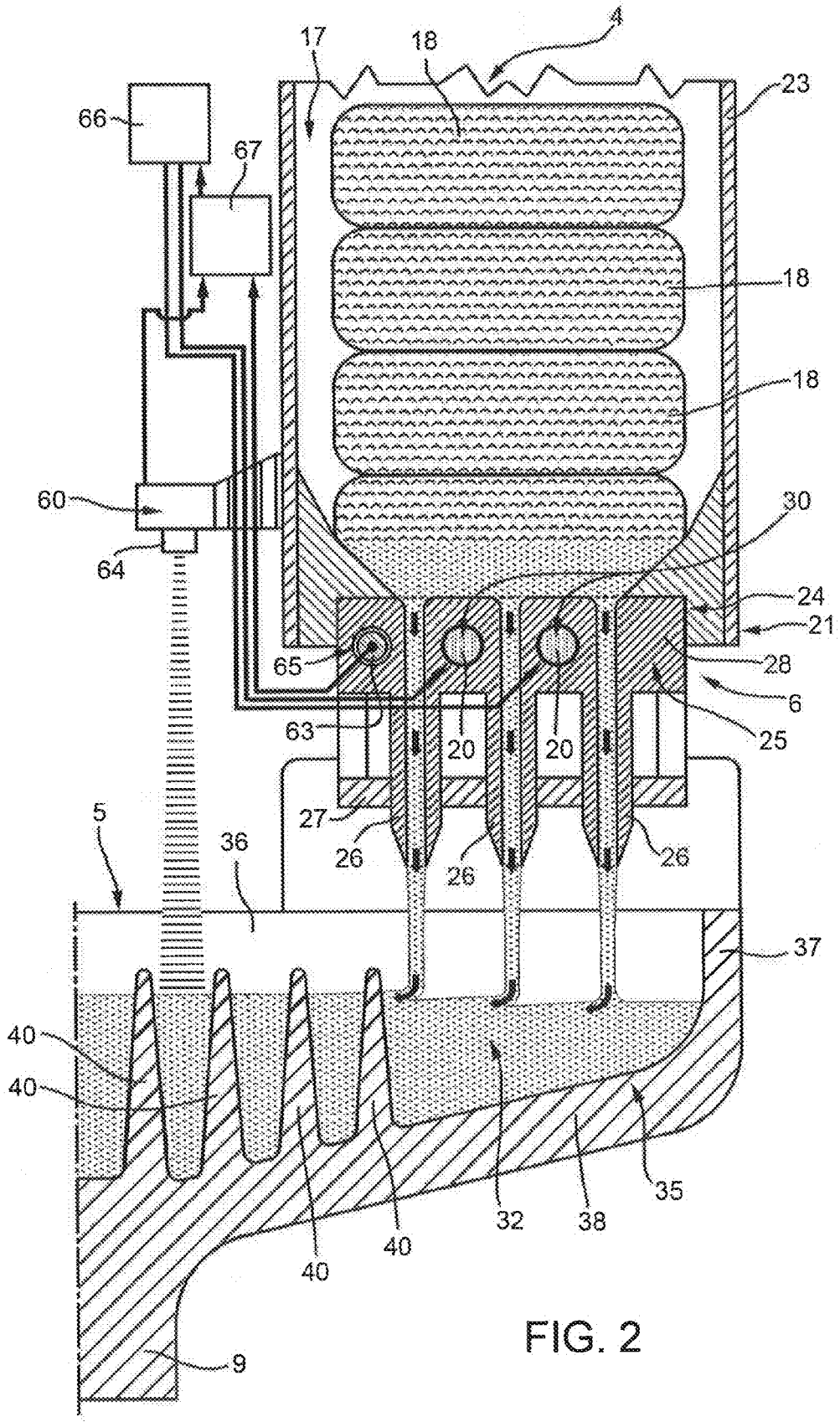
FIG. 2 shows a larger-scale detail of the gluing system of FIG. 1.

With reference to FIGS. 1 and 2, storage container 4 defines a chamber 17 configured to house a stack of solid glue blocks 18 and to maintain them in the solid state at an ambient temperature, preferably ranging between 25° C. and 40° C.; feeding means 6 comprise one or more heaters, preferably defined by one or more electric resistive elements 20, carried by a lower portion 21 of storage container 4 and selectively activated on demand to melt at least a portion of the lowest glue block 18 in the stack in such a way that the melted glue is fed to storage container 4.

As visible in FIGS. 1 and 2, each glue block 18 is preferably defined by a "pillow-shaped" body of solid glue, externally sealed by a plastic film which melts together with the glue by the action of electric resistive elements 20.

In the example shown, storage container 4 is delimited by a lateral wall 23 and has a reclosable upper aperture (not visible in FIGS. 1 and 2) to insert glue blocks 18 within chamber 17 and a lower aperture 24 closed by a melting plate 25 provided with electric resistive elements 20.

More specifically, melting plate 25 is preferably made in a thermally-conductive material, such as aluminum, and is provided with a plurality of drop tubes 26, nine in the examples shown, through which the melted glue flows from chamber 17 to sump 5.

As visible in FIGS. 1 and 2, drop tubes 26 project downwards from melting plate 25 and have respective axes parallel to axes A, B.

According to a preferred embodiment of the present invention, melting plate 25 is covered at the bottom by a layer 27 of thermal insulating material.

Melting plate 25 has an upper portion 28 defining one or more seats or cavities 30, which house respective electric resistive elements 20.

Cavities 30 are defined by horizontal holes formed in upper portion 28 of melting plate 25 and having respective axes orthogonal to those of drop tubes 26. Cavities 30 are also arranged close to respective drop tubes 26.

With reference to FIGS. 1 to 4, sump 5 is advantageously divided by a partition 31 into a first chamber 32, containing fresh melted glue, and a second chamber 33, containing excess melted glue.

Figure 4:
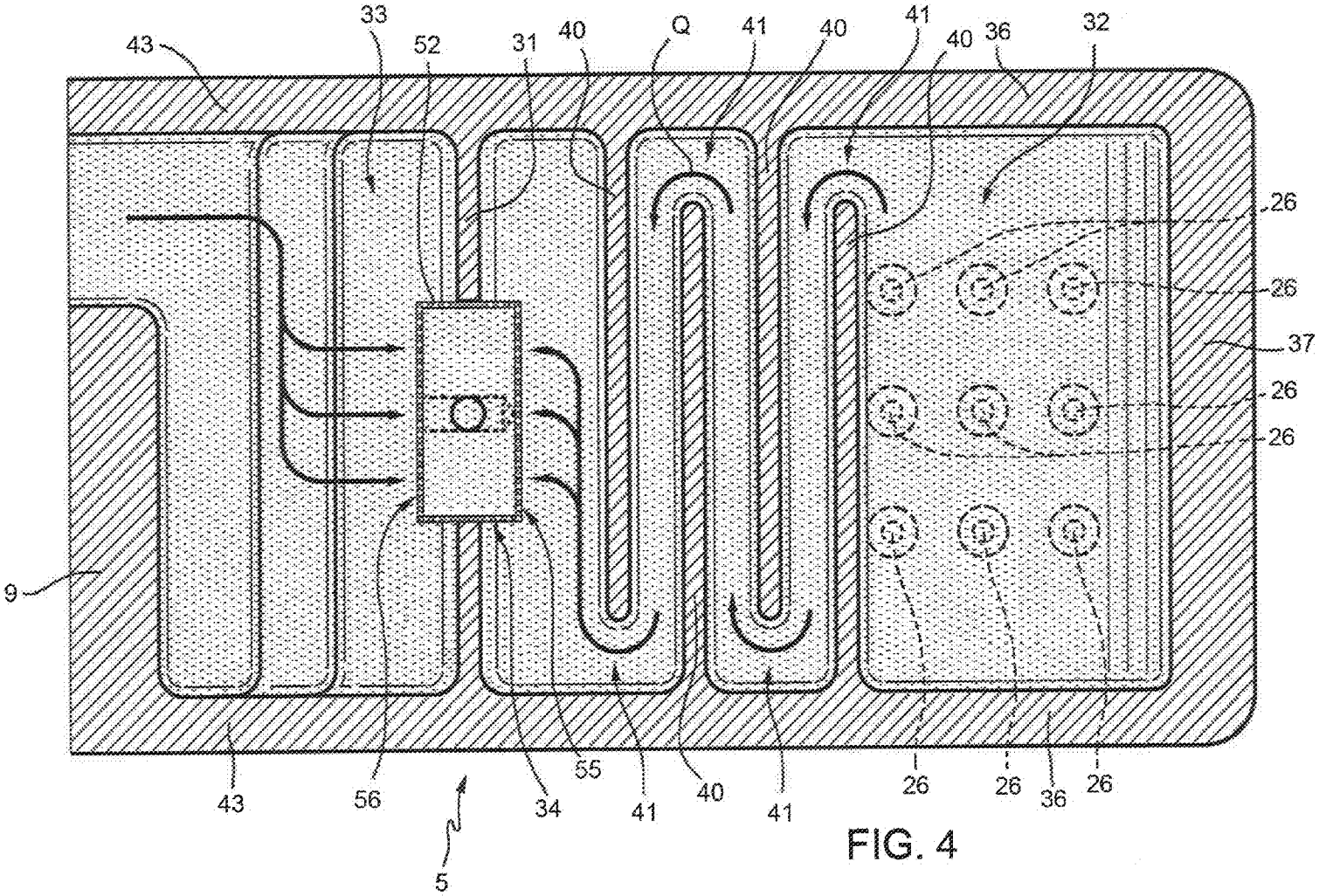
FIG. 4 shows a larger-scale section along line IV-IV of FIG. 1.

Chambers 32, 33 are separated by partition 31 and communicates with delivering means 7 through a filter 34 carried by the partition 31 itself and adapted to remove debris mainly present in the excess glue recirculated to the sump 5. In practice, as shown in FIG. 4, filter 34 is mounted within a seat of partition 31 and allows flow of the melted glue from both chambers 32, 33 to delivering means 7.

Chamber 32 is placed in part below drop tubes 26 to receive fresh melted glue therefrom, whilst chamber 33 is placed in part below glue roller 10 to receive excess glue removed by scraper 16 from lateral surface 11 of the glue roller 10 itself.

In particular (see FIG. 4), chamber 32 is delimited by a ramp-shaped bottom wall 35, descending towards partition 31, by opposite lateral walls 36, orthogonal to partition 31, and by an end wall 37 facing partition 31 and parallel thereto. Bottom wall 35 has an end portion 38, adjacent to end wall 37 and facing drop tubes 26 so as to receive in use fresh melted glue from storage container 4.

Chamber 32 further comprises two or more intermediate walls 40, parallel to partition 31 and alternatively delimiting respective glue passages 41 with opposite lateral walls 36 to generate a labyrinth path Q of the fresh melted glue towards filter 34.

In order to ensure movement of the melted glue along labyrinth path Q, the glue in chamber 32 is constantly maintained at a level not exceeding the overall height of intermediate walls 40.

In a completely analogous manner to chamber 32, chamber 33 is delimited by a ramp-shaped bottom wall 42, descending towards partition 31, by opposite lateral walls 43, orthogonal to partition 31 and coplanar with the respective lateral walls 36 of chamber 32, and by an end wall 44 facing partition 31, parallel thereto and placed on the opposite side of the partition 31 itself with respect to end wall 37. Bottom wall 42 has an end portion 45 adjacent to end wall 44 and facing glue roller 10 so as to receive in use excess melted glue therefrom.

With reference to FIG. 1, delivering means 7 comprise:

- a delivering conduit 46 extending from filter 34 and adapted to produce a continuous flow of melted glue from sump 5; and
- a pump 47 arranged in series along delivering conduit 46 and adapted to pump the melted glue through the delivering conduit 46 itself towards lateral surface 11 of glue roller 10.

In particular, delivering conduit 46 has a first portion 48, formed through base structure 9 and extending from filter 34, and a second portion 49 formed through an upright 50 projecting upwards from the base structure 9 and facing in part lateral surface 11 of glue roller 10.

More specifically, portion 49 of delivering conduit 46 has a plurality of horizontal ports 51 allowing the melted glue circulating along delivering conduit 46 to be ejected from the latter so as to deposit on the lateral surface 11 of glue roller 10.

Pump 47 is preferably arranged on portion 48 of delivering conduit 46.

Figure 3:
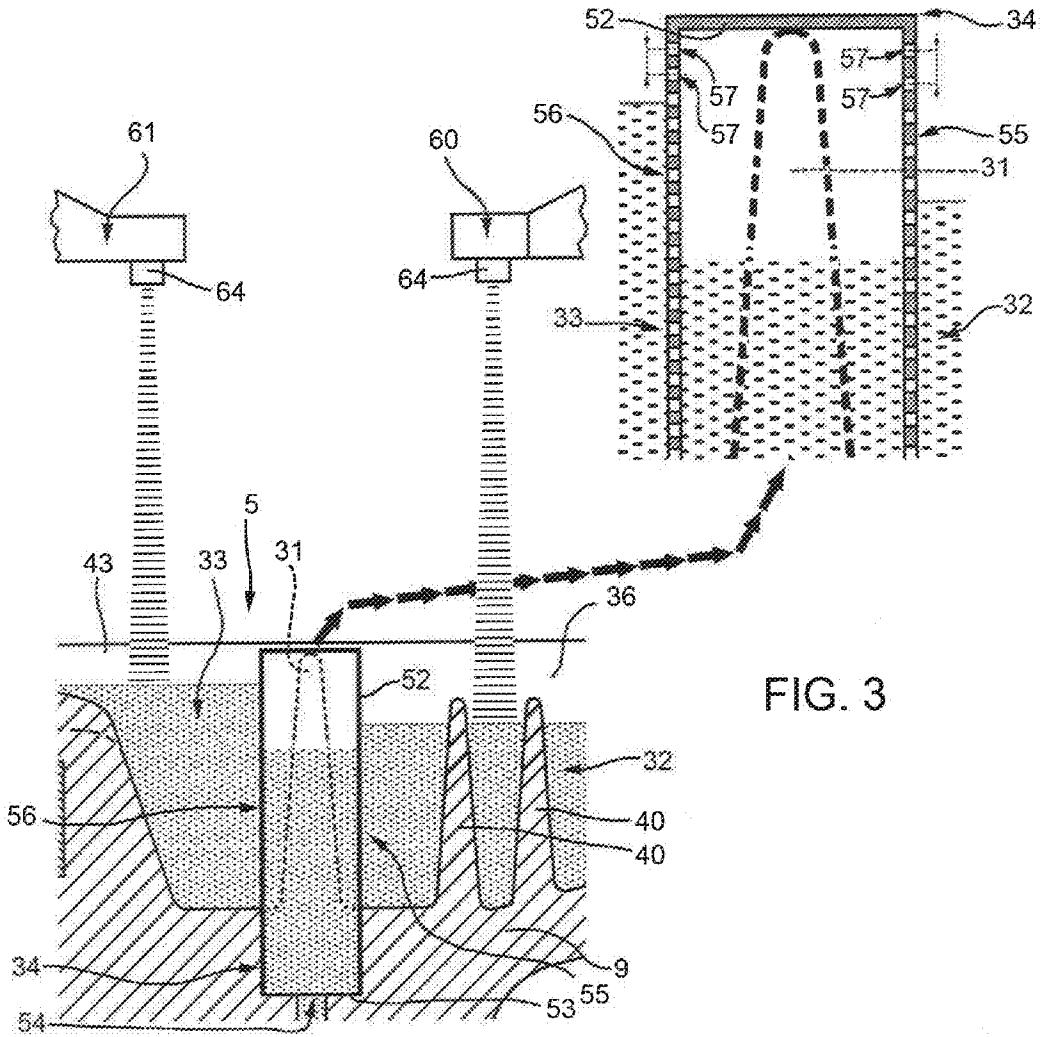
FIG. 3 shows another larger-scale detail of the gluing system of FIG. 1.

With particular reference to FIGS. 3 and 4, filter 34 has a box shape and is arranged at the deepest region of sump 5. In greater details, filter 34 has a first portion 52 extending within sump 5, through the relative seat formed in partition 31, and a second portion 53 projecting downwards from a bottom outlet of sump 5.

More specifically, portion 53 of filter 34 is arranged within base structure 9 and has an outlet 54 connected to portion 48 of delivering conduit 46.

Portion 52 of filter 34 is delimited by a first porous surface 55, facing chamber 32, and by an opposite porous surface 56 facing chamber 33.

Porous surfaces 55, 56 are both provided with through holes 57 allowing in use passage of melted glue coming from chambers 32, 33 towards delivering conduit 46.

Holes 57 of porous surfaces 55, 56 preferably have identical section areas, i.e. the same diameters.

In the example shown in FIG. 3, porous surface 56 has a greater number of holes 57 than porous surface 55 so as to prioritize the flow of excess melted glue from chamber 33 with respect to the flow of fresh melted glue from chamber 32.

With reference to FIGS. 1 to 3, system 1 further comprises a first level sensor 60, configured to detect the level of the melted glue in chamber 32 of sump 5, a second level sensor 61, configured to detect the level of the melted glue in chamber 33 of sump 5, and a temperature sensor 63, configured to detect temperature of melting plate 25.

In the example shown, level sensors 60, 61 are defined by ultrasonic sensors facing the free surfaces of the melted glue in respective chambers 32, 33. In particular, level sensor 60 is preferably mounted externally on lateral wall 23 of storage container 4, whilst level sensor 61 is preferably mounted on upright 50.

Each level sensor 60, 61 comprises an emitting transducer 64 (known per se and only schematically shown in FIGS. 1 and 2), which continuously emits ultrasonic waves towards the respective chamber 32, 33 of sump 5; the waves are then reflected back by the free surface of the melted glue in such chamber 32, 33 to the transducer 64 and detected by the latter.

As a possible alternative not shown, ultrasonic level sensors 60, 61 may be replaced by other types of level sensors, such as conventional float level sensors.

Temperature sensor 63 is housed in a seat or cavity 65 formed in upper portion 28 of melting plate 25 and extending parallel to cavities 30.

With reference to FIG. 1, system 1 further comprises a control unit or controller 66 receiving a first level signal S1 by level sensor 60, a second level signal S2 by level sensor 61 and a temperature signal S3 by temperature sensor 63; system 1 also comprises a power unit 67 for energizing electric resistive elements 20 on the basis of such signals S1, S2, S3 and in such a way to maintain the level of the melted glue in chamber 32 lower than that in chamber 33; this guarantees that the flow of melted glue from chamber 33 is prioritized with respect to the flow of melted glue from chamber 32.

In practice, control unit 66 and power unit 67 control supply of fresh melted glue in chamber 32 as a function of the detected glue levels in chambers 32 and 33 and as a function of the detected temperature of melting plate 25.

More specifically, power unit 67 is activated by control unit 66 to energize electric resistive elements 20 as the glue level in chamber 32 detected by level sensor 60 falls below a given threshold value L0, which is in turn set to differ of a given value D0 from the detected glue level in chamber 33; power unit 67, and therefore electric resistive elements 20, are deactivated by control unit 66 as the difference between the glue levels in chambers 32 and 33 falls below value D0 or as the temperature of melting plate 25 detected by temperature sensor 63 reaches a target threshold value T0.

In order to maintain a specific glue level in chamber 33, it is possible to fine tune the speed of pump 47, so as to create the necessary flow rates through filter 34.

In use, labels 2 are rotated, one after the other, by transfer drum 12 along path P towards the application station of the labels 2 themselves on respective articles.

In particular, each label 2 is supported by transfer drum 12 along the side destined to define the front surface when the label 2 itself is applied onto the respective article.

During rotation of transfer drum 12 about axis B, each label 2 interacts with glue roller 10 for receiving from the latter a layer of melted glue on its back surface opposite the one contacting the transfer drum 12.

Glue roller 10 also rotates about its axis A in a direction opposite the one of transfer drum 12. Glue roller 10 receives the melted glue from delivering conduit 46 and interacts with scraper 16 prior to contacting the labels 2 to be provided with glue. In particular, scraper 16 removes the excess glue from glue roller 10 before the latter distributes the glue on a respective label 2.

Excess glue removed by scraper 16 falls by gravity into chamber 33 of sump 5 and descends towards filter 34.

Due to the fact that the melted glue in chamber 33 is maintained by control unit 66 at a level higher than that in chamber 32 and also to the fact that porous surface 56 has a higher porosity than porous surface 55, the flow of excess melted glue from chamber 33 to delivering conduit 46 is prioritized with respect to the flow of fresh melted glue from chamber 32.

In particular, the value D0 of the difference between the glue levels in chambers 32 and 33 and the different porosity of porous surfaces 55, 56 are chosen so as to ensure that about 90% of the glue fed to glue roller 10 is formed by excess glue discharged by scraper 16 and recirculated by delivering conduit 46; the other 10% of the glue fed to glue roller 10 is instead formed by fresh melted glue coming from chamber 32 and therefore from storage container 4.

More specifically, the lowest glue block 18 in the stack within chamber 17 of storage container 4 is melted on demand by melting plate 25 and fed to chamber 32 of sump 5 to replenish the consumed glue.

In practice, lever sensors 60, 61 continuously detect the glue levels in respective chambers 32, 33 of sump 5; when the detected glue level in chamber 32 falls below threshold value L0, which is in turn set to differ of value D0 from the glue level in chamber 33, control unit 66 activates power unit 67 so as to energize electric resistive elements 20 in melting plate 25; in this way, a portion of the lowest glue block 18 in the stack stored in chamber 17 of storage container 4 is melted and flows through drop tubes 26 towards chamber 32.

Once fallen into chamber 32, the fresh melted glue follows labyrinth path Q to reach filter 34; along this long path, the temperature of the fresh melted glue coming from storage container 4 increases by moving towards filter 34 and stabilizes at the desired value requested to be then fed to glue roller 10.

As the target temperature T0 of melting plate 25 is reached or the difference of glue levels in chambers 32, 33 falls below value D0, control unit 66 deactivates power unit 67 and electric resistive elements 20.

Figure 5:
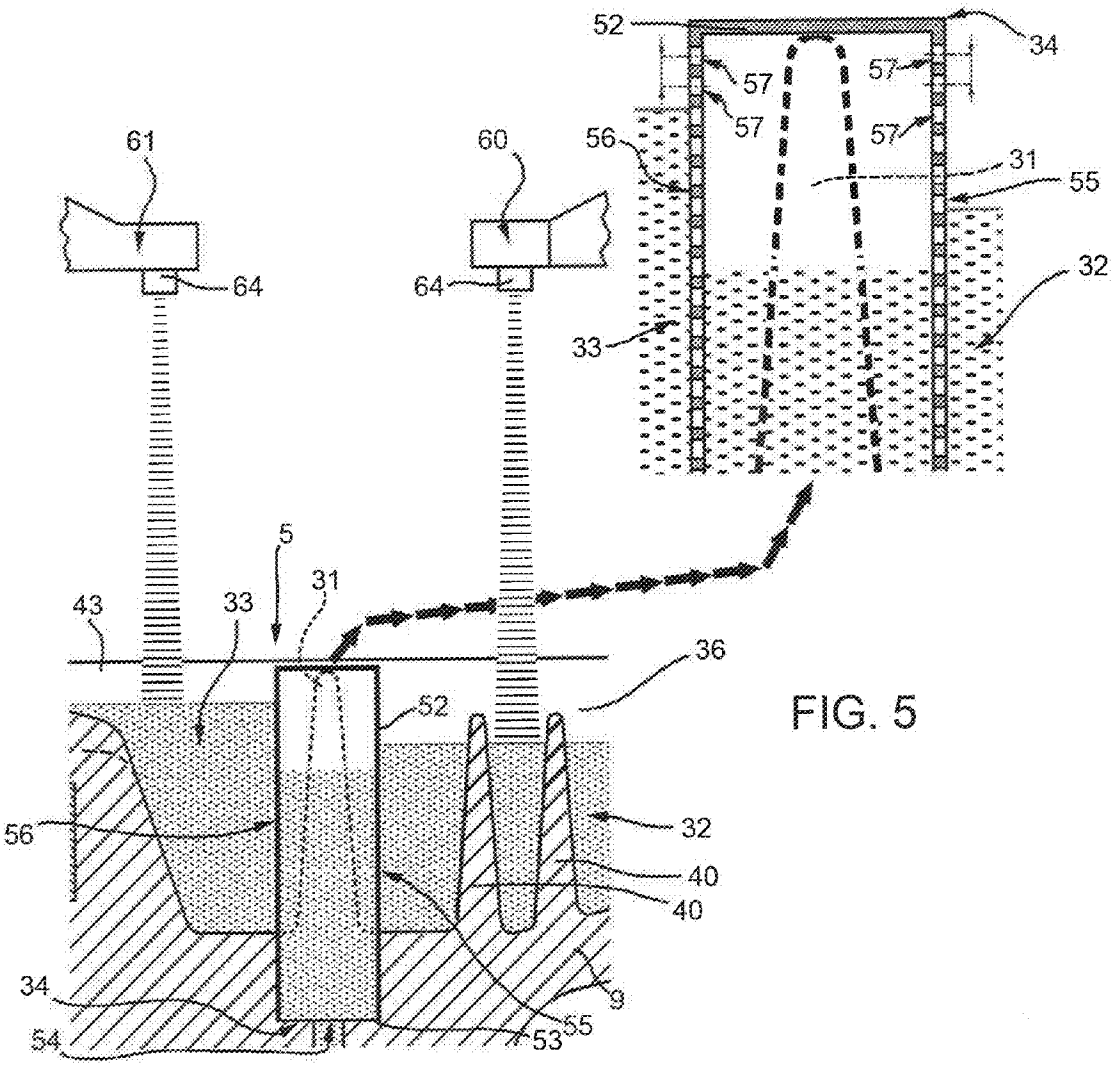
FIG. 5 is similar to FIG. 3 and shows a larger-scale detail of a possible variant of the gluing system of FIG. 1.

The variant of FIG. 5 relates to a solution in which porous surfaces 55, 56 of filter 34 have the same porosity, i.e. the same numbers of holes 57. In this case, prioritization of the flow of melted glue from chamber 33 with respect to the flow of melted glue from chamber 32 is achieved by only controlling the glue levels in the chambers 32, 33 through level sensors 60, 61 and by energizing electric resistive elements 20 in such a way to maintain the difference between such glue levels at value D0.

The advantages of gluing system 1 according to the present invention will be clear from the foregoing description.

In particular, by using a partition 31 in sump 5, any possible contamination of the fresh melted glue by the older recirculated glue is avoided. In practice, the chamber 32 destined to receive fresh melted glue remains uncontaminated by recirculated glue and debris.

In addition, thanks to the fact that the flow from chamber 33 to delivering means 7 is prioritized with respect to the flow from chamber 32, it is possible to minimize the time in which excess glue discharged by glue roller 10 is recirculated prior to being applied on labels 2. In this way, the glue deposited on labels 2 is less exposed to atmospheric and thermal degradation than in conventional gluing systems. It is in fact known that hot melt glues are best used when they are applied shortly after melting from their solid condition.

The presence of intermediate walls 40 in chamber 32 increases the "travel" made by fresh melted glue to reach filter 34; in this way, the temperature of fresh melted glue can be stabilized prior to being delivered to glue roller 10; furthermore, the labyrinth path Q traveled by fresh melted glue permits to ensure that the glue first entering sump 5 is first delivered to glue roller 10.

Thanks to the fact that glue is stored in solid blocks 18 in storage container 4, only the minimal necessary amount of glue to maintain the glue application process is melted to replenish sump 5 with the consumed glue.

As a consequence, only a minimal amount of glue is heated and circulated between the storage container 4 and the glue roller 10. This translates into less glue degradation due to the action of time and heating as well as less mass of glue circulating in system 1. Parallel to this, the solid volume in the storage container 4 is maximised so as to reduce operator attendance.

In general, the above-described gluing system 1 requires the use of relatively small storage container 4 and sump 5 as well as reduced manufacture and maintenance costs with respect to known gluing systems.

Plus, the storage container 4 has less hot surfaces to insulate and protect for security of operators than known tanks housing hot glue.

Clearly, changes may be made to gluing system 1 as described and illustrated herein without, however, departing from the scope of protection as defined in the accompanying claims.

The invention claimed is:

1. A gluing system for applying a glue on products, comprising:

a glue applicator including a glue roller having a lateral surface configured to deposit a melted glue on products;

a first glue container configured to store the glue that is discharged as a fresh melted glue;

a second glue container configured to contain an excess melted glue discharged from the glue applicator and to contain the fresh melted glue discharged from the first glue container; and a delivering conduit device configured to deliver the glue from the second glue container to the glue applicator;

wherein the second glue container is divided by a partition into a first chamber, containing the fresh melted glue, and into a second chamber containing the excess melted glue and separated from the first chamber;

wherein the partition includes a filter allowing flow of the fresh melted glue from the first chamber and the excess melted glue from the second chamber to the delivering conduit; and wherein a first portion of the delivering conduit extends from the filter, and a second portion of the delivering conduit delivers the glue through a plurality of holes onto the lateral surface of the glue roller.

2. The system as claimed in claim 1, further comprising a controller configured to maintain a level of the fresh melted glue in the first chamber lower than a level of the excess melted glue in the second chamber, such that the flow of the excess melted glue from the second chamber to the delivering conduit is greater than the flow of the fresh melted glue from the first chamber to the delivering conduit.

3. The system as claimed in claim 2, wherein the controller includes:

a first level sensor configured to detect the level of the fresh melted glue in the first chamber;

a second level sensor configured to detect the level of the excess melted glue in the second chamber, the controller is configured to control supply of the fresh melted glue in the first chamber as a function of detected glue levels in the first and second chambers.

4. The system as claimed in claim 1, wherein the filter has a first porous surface, facing the first chamber, and a second porous surface facing the second chamber; and wherein both the first and second porous surfaces are provided with through holes for allowing passage of the fresh melted glue and the excess melted glue towards the delivering conduit.

5. The system as claimed in claim 4, wherein the through holes of the first and second porous surfaces have the diameters of a same length.

6. The system as claimed in claim 4, wherein the second porous surface has a larger number of through holes than the first porous surface, such that the flow of the excess melted glue from the second chamber to the delivering conduit is greater than the flow of the fresh melted glue from the first chamber to the delivering conduit.

7. The system as claimed in claim 4, wherein the first porous surface has a same porosity as the second porous surface.

8. The system as claimed in claim 1, further comprising a glue feeder selectively activated to feed the fresh melted glue to the first chamber.

9. The system as claimed in 8, wherein the first chamber is delimited by a bottom wall, by a lateral wall and by the partition provided with the filter;

wherein the bottom wall has a ramp-shaped portion receiving the fresh melted glue from the glue feeder and descending towards the partition and the filter; and wherein the first chamber further comprises at least one intermediate wall parallel to the partition and delimiting a glue passage with a portion of the lateral wall to slow down movement of the fresh melted glue towards the filter.

10. The system as claimed in claim 9, wherein the first chamber comprises two or more intermediate walls parallel to the partition and alternatively delimiting respective glue passages with opposite facing portions of the lateral wall to generate a labyrinth path of the fresh melted glue towards the filter.

11. The system as claimed in claim 8, wherein the first glue container is connected to the glue feeder.

12. The system as claimed in claim 11, wherein the first glue container defines a third chamber configured to house a stack of solid glue blocks and to maintain the glue blocks in the solid state; and wherein the glue feeder includes a heater mounted on a lower portion of the first glue container and selectively activated to melt at least a portion of a lowest glue block in the stack in such a way that the fresh melted glue is delivered to the second glue container.

13. The system as claimed in claim 12, wherein the third chamber of the first glue container is delimited at the bottom by a melting plate carrying the heater.

14. The system as claimed in claim 12, wherein the heater includes at least one electric resistive element.

15. The system as claimed in claim 1, wherein the second glue container includes a sump.

* * * * *